US007445514B2

(12) United States Patent
Cao et al.

(10) Patent No.: US 7,445,514 B2
(45) Date of Patent: Nov. 4, 2008

(54) ELECTRICAL CONNECTOR

(75) Inventors: Shu-Zhao Cao, ShenZhen (CN); Chang-Hsin Hsu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/894,127

(22) Filed: Aug. 20, 2007

(65) Prior Publication Data

US 2008/0045089 A1 Feb. 21, 2008

(51) Int. Cl.
*H01R 24/00* (2006.01)

(52) U.S. Cl. ..... 439/660; 439/603

(58) Field of Classification Search ..... 439/660, 439/873, 603, 74

See application file for complete search history.

(56) References Cited

U.S. PATENT DOCUMENTS 5,116,247 A * 5/1992 Enomoto et al. ..... 439/660
5,888,077 A * 3/1999 Champion et al. ..... 439/108
5,915,976 A * 6/1999 McHugh ..... 439/74
6,068,517 A * 5/2000 Tanaka ..... 439/660
6,106,306 A * 8/2000 Koga et al. ..... 439/74
6,296,524 B1 * 10/2001 Goto ..... 439/660
6,540,561 B1 * 4/2003 Masumoto ..... 439/660
6,743,060 B2 * 6/2004 Wu ..... 439/741
6,764,314 B1 * 7/2004 Lee ..... 439/65
6,811,411 B1 * 11/2004 Hirata et al. ..... 439/74
6,881,075 B2 * 4/2005 Huang et al. ..... 439/74
6,976,853 B2 * 12/2005 Goto ..... 439/74
7,037,117 B2 * 5/2006 Goto ..... 439/74
7,074,085 B2 * 7/2006 Chen ..... 439/607
7,128,581 B2 * 10/2006 Igarashi et al. ..... 439/74
7,172,433 B2 * 2/2007 Tsai ..... 439/74
7,320,605 B2 * 1/2008 Chang et al. ..... 439/74
7,338,318 B2 * 3/2008 Shen et al. ..... 439/571
2005/0032434 A1 * 2/2005 Zhang et al. ..... 439/660

* cited by examiner

*Primary Examiner*—Ross N Gushi
(74) *Attorney, Agent, or Firm*—Wei Te Chung

(57) ABSTRACT

An electrical connector comprises a housing and a number of terminals residing in the housing. Each of terminals comprises a base portion, a contact portion extending from the base portion, and a retention portion rising from the base portion. The housing defines a number of terminal-mounting holes each with a receiving cavity and an engaging cavity. Along a longitudinal direction of the housing, the width of the receiving cavity is greater than the thickness of the retention portion and the width of the engaging cavity is less than the thickness of the retention portion.

15 Claims, 5 Drawing Sheets

1

1

ELECTRICAL CONNECTOR

BACKGROUND OF THE INVENTION

1. Field of the Invention

The present invention relates to the art of an electrical connector for matting with a complementary component.

2. Description of the Prior Art

One type of conventional electrical connector comprises an insulating housing defining a plurality of passageways and a number of terminals received in the passageways for matting with a complementary component. The terminals have a number of retention barbs extending from one or two side edges thereof. Each retention barb is firmly held in the passageways so as to securely fix the terminal in the housing.

The trend toward miniaturization of electrical connectors requires precise positioning of the terminals in the passageways. Conventional terminals are too small to be accurately inserted into the passageways of a housing of an electrical connector. When the retention barbs engage with the wall of housing, small gaps remain between retention portion of each terminal and uninterferential walls of the passageways. In addition, the terminals may be inaccurately installed in the corresponding passageways during assembly of the electrical connector. For example, some terminals may be inserted at incorrect angles. The above-mentioned small gaps can be eliminated by ensuring that a thickness of each retention portion of the terminals is exactly equal to a width of each passageway of the housing. However, insertion of the terminals into the passageway is difficult and problematic. Forced insertion can result in plastic deformation of the housing at the passageway, and damage to the terminals has not yet been satisfactorily resolved.

Hence, it is strongly desired to provide a new electrical connector which overcomes the disadvantages of the prior art described immediately above.

SUMMARY OF THE INVENTION

Accordingly, an object of the present invention is to provide a new electrical connector providing accurate positioning of terminals therein.

To fulfill the above-mentioned object, a new electrical connector provided in accordance with the present invention comprises a housing and a number of terminals residing in the housing. Each of terminals comprises a base portion, a contact portion extending from the base portion, and a retention portion rising from the base portion. The housing defines a plurality of terminal-mounting grooves with a receiving cavity and an engaging cavity. Along a longitudinal direction of the housing, the width of the receiving cavity is greater than the thickness of the retention portion and the width of the engaging cavity is less than the thickness of the retention portion.

With this configuration, each retention portion of the terminals does not engage with the receiving cavity of the terminal-mounting groove, so as to reduce forced insertion when each retention portion of the terminals abuts against the interior surface of terminal-mounting groove and hold the terminals in the housing by press-fitting the retention portion into the engaging cavity of terminal-mounting groove. The press-fit enables retention portion to positively retain the terminals in the housing. Furthermore, the retention barbs, the contact heads and the retentions head of the terminals are all cut into the opposing inner walls of the housing, thereby fixing the terminals in the housing firmly.

Other objects, features and advantages of the present invention will become more apparent from the following detailed description when taken in conjunction with the accompanying drawings.

BRIEF DESCRIPTION OF THE DRAWINGS

The features of the present invention which are believed to be novel are set forth with particularity in the appended claims. The invention, together with its object and the advantage thereof, may be best understood by reference to the following detailed description when taken in conjunction with the accompanying drawings, in which like reference numerals identify like elements in the figures and in which:

DETAILED DESCRIPTION OF THE PREFERRED EMBODIMENT

Figure 1:
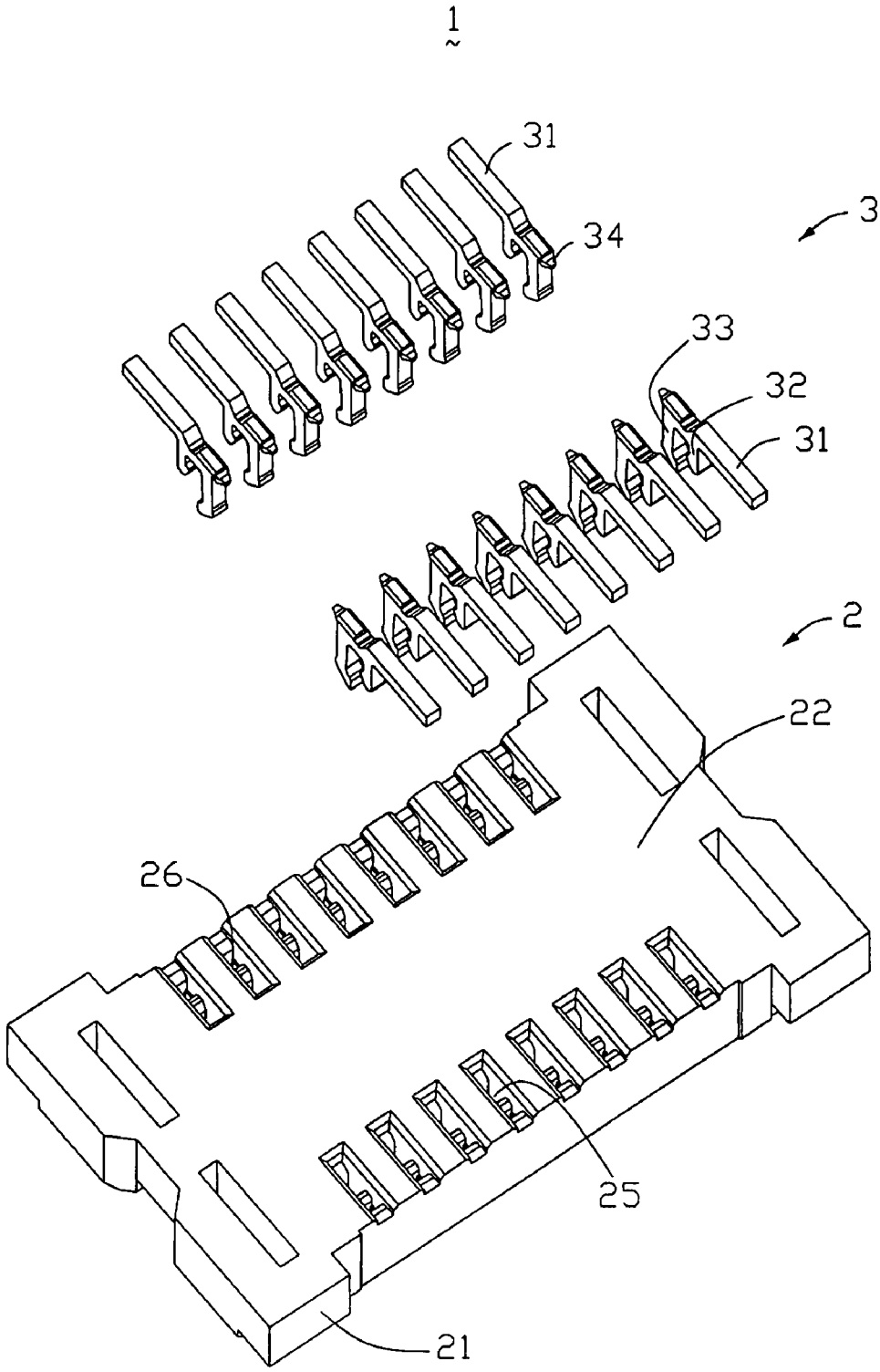
FIG. 1 is an exploded perspective view of the electrical connector according to a preferred embodiment of the present invention.
Figure 2:
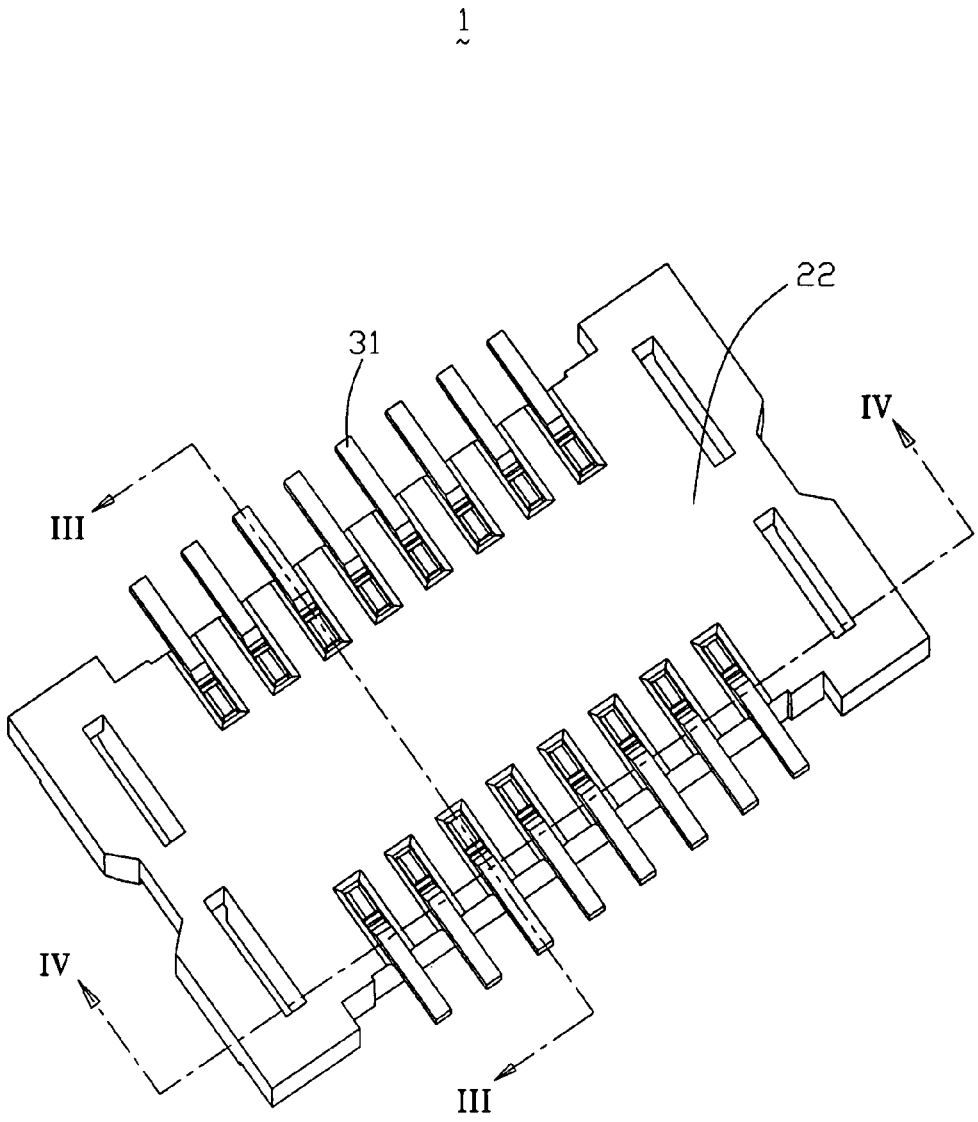
FIG. 2 is an assembled, perspective view of the electrical connector of FIG. 1.

Reference will now be made to describe the preferred embodiment of the present invention in detail.

Referring to FIGS. 1-5, an electrical connector 1 for matting with a complementary component includes an insulating housing 2 and a number of terminals 3 arranged at regular intervals along the longitudinal direction of the housing 2.

The terminals 3 may be formed from metal sheet in a known manner, such as by stamping and forming. Each of terminals 3 integrally includes a horizontal base or body portion 31, a contact portion 33 having a generally L-shaped free end that extends from a front end of the base portion 31, a retention portion 32 rising from the base portion 31, and a retention barb 34 extending from the contact portion 33.

Each contact portion 33 of the terminals 3 has a contact head 35 projecting from the free end thereof, and each retention portion 32 has a retention head 36 projecting from the free end thereof.

The insulated housing 2 includes a bottom surface 22, a rectangular projection 23 extending from the bottom surface 22 and a series of sidewalls 21 partly surrounding the projection 23. The projection 23 has a receiving space 20 for receiving the complementary component.

The sidewalls 21 all having a same height are lower than the height of projection 23, and the top surfaces of the sidewalls 21 are coplanar with each other, respectively. The projection 23 and each sidewall 21 cooperatively define a matting channel 24 therebetween.

Along the longitudinal direction of the housing 2, the terminal-receiving holes 25 pass through the projection along the vertical direction of projection 23. The housing 2 also has a plurality of terminal-mounting grooves 26 formed therein, in order to accommodate the retention portions 32 of the terminals 3. Each of the terminal-mounting grooves 26 is stepped and aligned with a corresponding terminal-receiving hole 25.

Each terminal-mounting groove 26 defines a receiving cavity 261 for accommodating the retention portion 32 of the terminal 3 and an engaging cavity 262 for engaging with the retention portion 32 of the terminal 3. Along the longitudinal direction of the housing 2, the width of the receiving cavity 261 is greater than the thickness of the retention portion 32 and the width of the engaging cavity 262 is less than the thickness of the retention portion 32.

Figure 3:
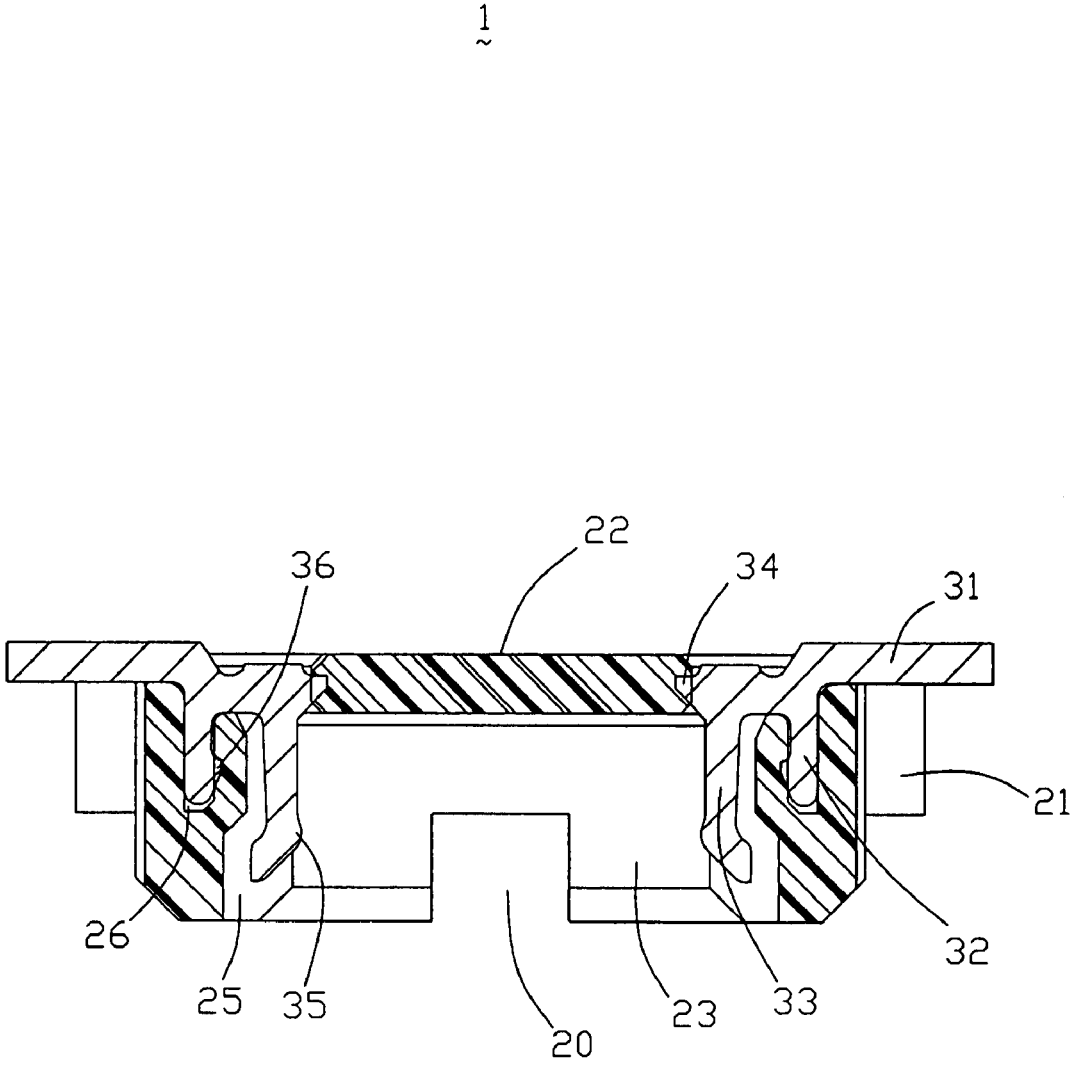
FIG. 3 is a sectional view taken along line III-III of FIG. 2.
Figure 4:
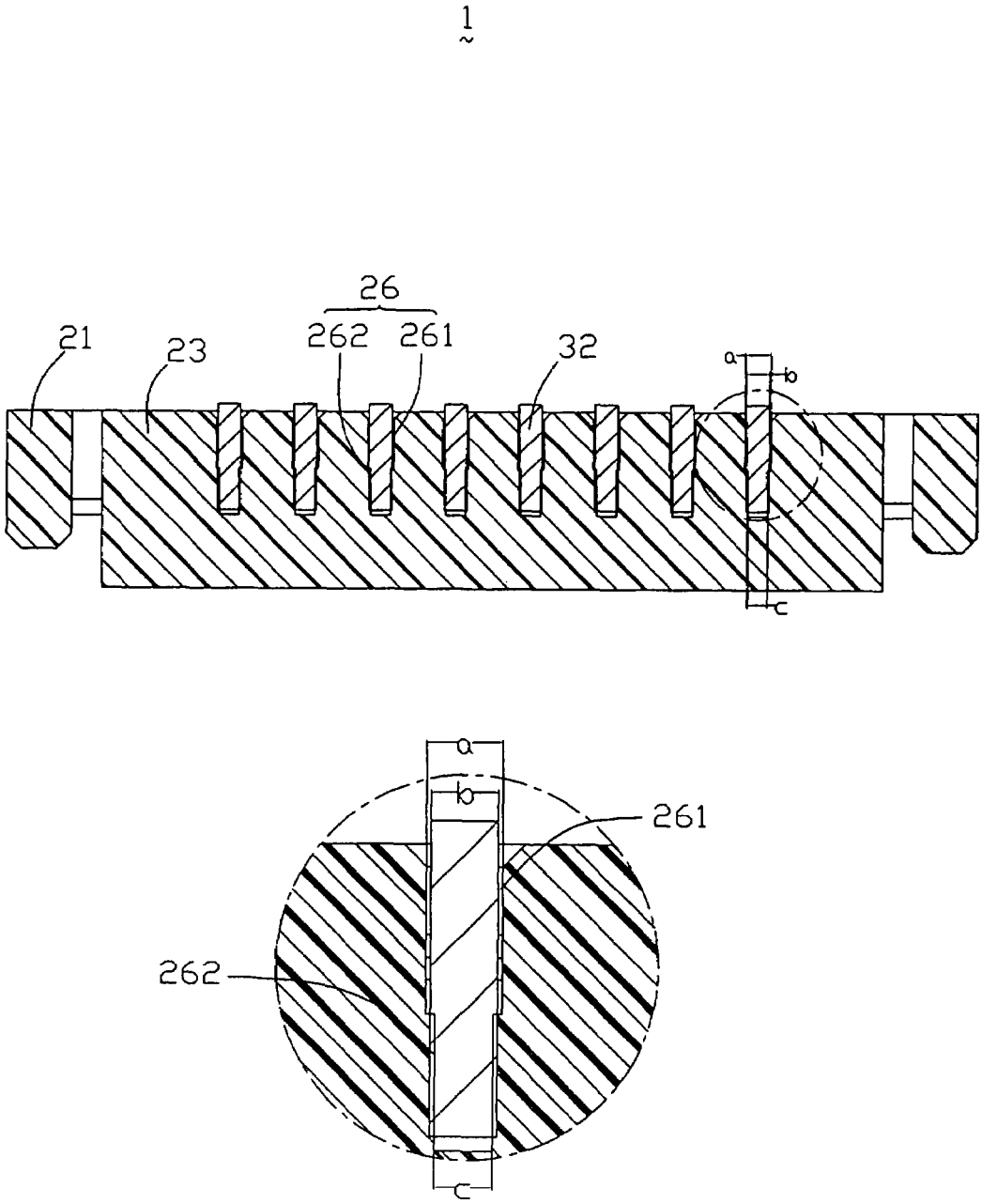
FIG. 4 is a sectional view taken along line IV-IV of FIG. 2.
Figure 5:
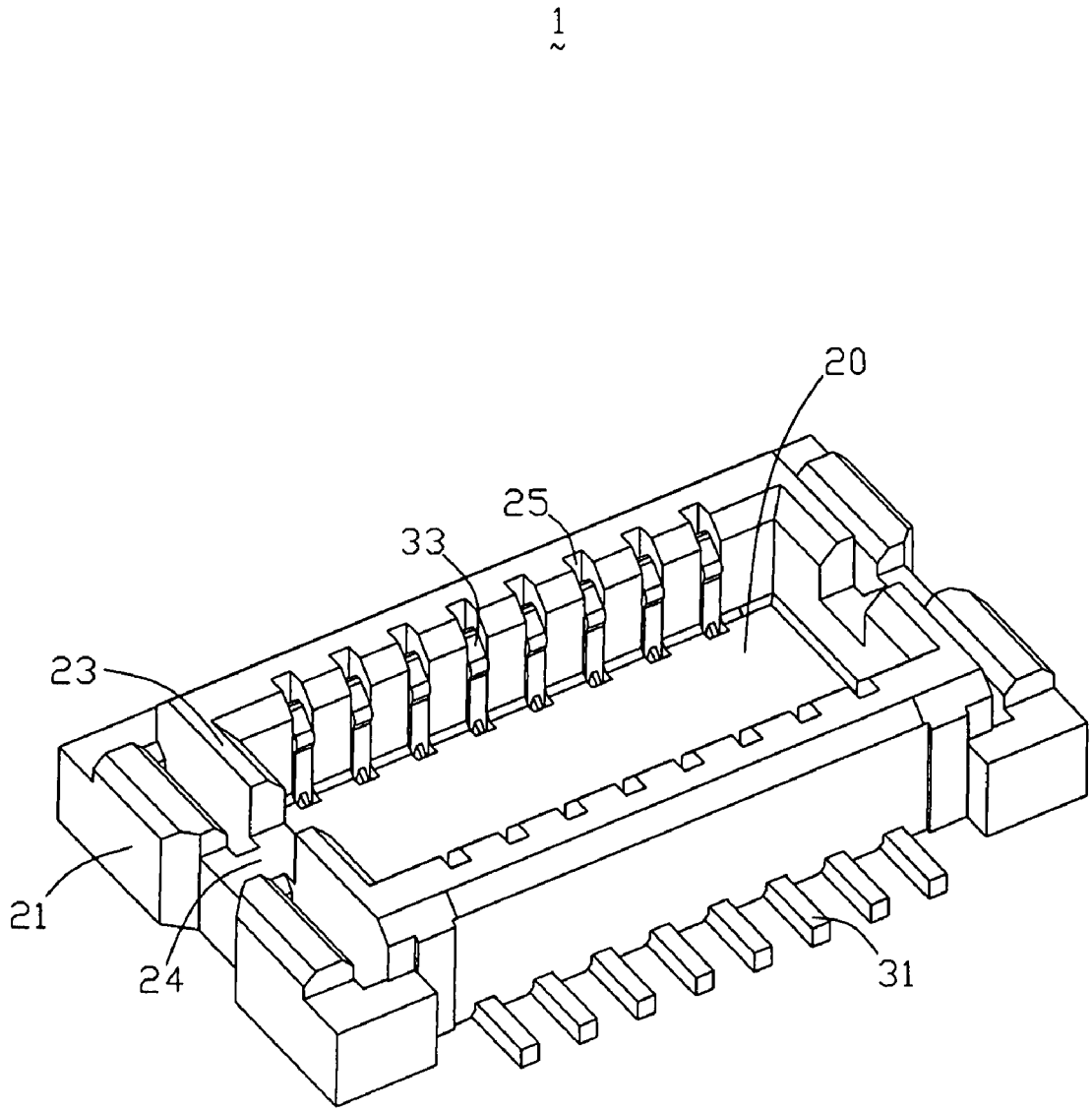
FIG. 5 is a view similar to FIG. 2, but showing the electrical connector of FIG. 2 from another view.

Referring to FIG. 3, in assembly, the terminals 3 are inserted into the terminal-receiving holes 25 and terminal-mounting grooves 26 from the bottom surface 22 of the housing 2. Each retention portion 32 of the terminals 3 is inserted into the corresponding terminal-mounting groove 26, and each contact portion 33 of the terminals 3 is received in the corresponding terminal-receiving hole 25. However, each retention portion 32 of the terminals does not engage with the receiving cavity 261 of the terminal-mounting groove 26, so as to reduce forced insertion when each retention portion 32 of the terminals 3 abuts against the interior surface of terminal-mounting groove 26 and assemble the terminals 3 in the housing 2 by press-fitting the retention portion 32 into the engaging cavity 262 of terminal-mounting groove 26. The press-fit enables retention portion 32 to positively retain the terminals 3 in the housing 2. Furthermore, the retention barb 34, the contact heads 35 and the retention heads 36 of the terminals 3 are all cut into the opposing inner walls of the housing 2, thereby fixing the terminals 3 in the housing 2 firmly.

While the present invention has been described with reference to a specific embodiment, the description of the invention is illustrative and is not to be construed as limiting the invention various modifications to the present invention can be made to the preferred embodiment by those skilled in the art without departing from the true spirit and scope of the invention as defined by the appended claims.

What is claimed is:

1. An electrical connector comprising:

an insulating housing defining a plurality of terminal-mounting grooves, each terminal-mounting groove having a receiving cavity and an engaging cavity; and a plurality of terminals secured to the insulating housing, each of the terminals comprising a base portion, a contact portion extending from the base portion, and a retention portion rising from the base portion and accommodated in the receiving cavity and engaged with the engaging cavity;

wherein, along a longitudinal direction of the housing, the width of the receiving cavity is greater than the thickness of the retention portion and the width of the engaging cavity is less than the thickness of the retention portion.

2. The electrical connector as defined in claim 1, wherein each contact portion of the terminals has a contact head projecting from the free end thereof, and each retention portion has a retention head projecting from the free end thereof.

3. The electrical connector as defined in claim 1, wherein each terminal has a retention barb.

4. The electrical connector as defined in claim 1, wherein the terminal-mounting groove is stepped.

5. The electrical connector as defined in claim 4, wherein said housing defines a number of terminal-receiving holes, each of said holes being aligned with a corresponding terminal-mounting groove.

6. The electrical connector as defined in claim 5, wherein the terminal-mounting grooves and the terminal-receiving holes are disposed on two longitudinal sides of the housing.

7. The electrical connector as defined in claim 6, wherein the housing defines a projection extending from a bottom surface thereof.

8. The electrical connector as defined in claim 7, wherein the terminal-receiving holes pass though the projection vertically.

9. The electrical connector as defined in claim 7, wherein the projection has a receiving space defined in a center thereof.

10. The electrical connector as defined in claim 7, wherein the housing has a plurality of sidewalls partly surrounding the projection, the sidewalls all having a same height lower than the height of the projection.

11. The electrical connector as defined in claim 10, wherein the sidewalls and the projection cooperatively define a mating channel therebetween.

12. An electrical connector comprising:

an insulative housing defining a plurality of terminal receiving holes and corresponding terminal mounting grooves therein; and a plurality of contacts disposed in the corresponding passageways, respectively, each of said contacts including a base with an upward extending retention tab received in the corresponding terminal mounting groove and defining a width and a thickness along a transverse direction and a lengthwise direction of said housing; wherein the retention tab defines a barb on said width along said transverse direction and interfering with the corresponding terminal mounting groove, and defining first and second sections in a vertical direction, perpendicular to both said transverse direction and said lengthwise direction, under a condition that the first section interferes with the terminal mounting groove in said lengthwise direction while the second section is not.

13. The electrical connector as claimed in claim 12, wherein said first section is located above the second section.

14. The electrical connector as claimed in claim 12, wherein said retention tab defines a constant thickness in said lengthwise direction while the terminal mounting groove is not.

15. The electrical connector as claimed in claim 12, wherein said terminal mounting groove defines an upper small segment and a lower large segment in said lengthwise direction.

* * * * *